US011225889B2

(12) United States Patent
Nakayama et al.

(10) Patent No.: US 11,225,889 B2
(45) Date of Patent: Jan. 18, 2022

(54) SILENCER AND EJECTOR IN WHICH SILENCER IS USED

(71) Applicant: SMC CORPORATION, Chiyoda-ku (JP)

(72) Inventors: Toru Nakayama, Soka (JP); Koji Sugano, Koshigaya (JP); Masayuki Enomoto, Moriya (JP); Masayoshi Yamamoto, Koshigaya (JP)

(73) Assignee: SMC CORPORATION, Chiyoda-ku (JP)

( * ) Notice: Subject to any disclaimer, the term of this patent is extended or adjusted under 35 U.S.C. 154(b) by 838 days.

(21) Appl. No.: 16/000,055

(22) Filed: Jun. 5, 2018

(65) Prior Publication Data

US 2018/0355773 A1 Dec. 13, 2018

(30) Foreign Application Priority Data

Jun. 9, 2017 (JP) ..... JP2017-114261

(51) Int. Cl.
*F01N 1/10* (2006.01)
*F04B 39/00* (2006.01)
(Continued)

(52) U.S. Cl.
CPC ..... *F01N 1/10* (2013.01); *F01N 1/085* (2013.01); *F04B 39/005* (2013.01);
(Continued)

(58) Field of Classification Search
CPC ..... F04B 39/005; F04B 39/0055; F04B 39/0083; F04C 29/063; B65H 2601/324;
(Continued)

(56) References Cited

U.S. PATENT DOCUMENTS 2,815,088 A * 12/1957 Gibel ..... F01N 1/082 181/230
3,208,551 A * 9/1965 Carls ..... F01B 17/00 181/226
(Continued)

FOREIGN PATENT DOCUMENTS

JP 1-66417 U 4/1989
JP 2003-120530 A 4/2003
(Continued)

OTHER PUBLICATIONS

Extended European Search Report dated Aug. 10, 2018 in Patent Application No. 18176233.7, 15 pages.
(Continued)

*Primary Examiner* — Jeremy A Luks
(74) *Attorney, Agent, or Firm* — Oblon, McClelland, Maier & Neustadt, L.L.P.

(57) ABSTRACT

A silencer is equipped with a hollow tubular portion in which a discharge flow passage is formed that communicates on one end side thereof with a discharge port of a fluid pressure device (ejector) through which a pressure fluid is discharged, a cap member attached to another end part of the tubular portion, a sound absorbing member attached to an inner wall surface of the tubular portion, and a plurality of discharge ports adapted to discharge the pressure fluid, which has passed through the discharge flow passage in an axial direction of the tubular portion, in radial directions perpendicular to the axial direction.

7 Claims, 8 Drawing Sheets

(51) Int. Cl.

| | |
|---|---|
| ***F04F 5/44*** | (2006.01) |
| ***F04F 5/20*** | (2006.01) |
| ***F04C 29/06*** | (2006.01) |
| ***F01N 1/08*** | (2006.01) |

(52) U.S. Cl.
CPC ..... *F04B 39/0055* (2013.01); *F04B 39/0083* (2013.01); *F04C 29/063* (2013.01); *F04F 5/20* (2013.01); *F04F 5/44* (2013.01); *B65H 2601/324* (2013.01)

(58) Field of Classification Search
CPC .... F04F 5/20; F04F 5/44; F01N 1/085; F01N 1/10
USPC ..... 181/230
See application file for complete search history.

(56) References Cited

U.S. PATENT DOCUMENTS

| | | | | | |
|---|---|---|---|---|---|
| 3,561,561 | A | * | 2/1971 | Trainor | F16L 55/033 181/267 |
| 3,949,828 | A | * | 4/1976 | Frochaux | G10K 11/161 181/230 |
| 4,073,602 | A | | 2/1978 | Cagle | |
| 4,134,472 | A | * | 1/1979 | Trainor | B01D 46/2411 181/230 |
| 4,241,805 | A | * | 12/1980 | Chance, Jr. | F01N 1/083 181/232 |
| 4,316,523 | A | * | 2/1982 | Boretti | B25D 17/12 181/226 |
| 4,749,058 | A | * | 6/1988 | Trainor | F15B 21/008 181/230 |
| 6,109,387 | A | * | 8/2000 | Boretti | F01N 1/082 181/217 |
| 9,095,983 | B2 | | 8/2015 | Perlman et al. | |
| 2003/0180154 | A1 | | 9/2003 | Yamazaki et al. | |
| 2009/0266643 | A1 | | 10/2009 | Fukano et al. | |
| 2012/0256433 | A1 | | 10/2012 | Fukano et al. | |
| 2013/0216352 | A1 | | 8/2013 | Short | |
| 2016/0258472 | A1 | | 9/2016 | Perlman et al. | |

FOREIGN PATENT DOCUMENTS

| | | |
|---|---|---|
| JP | 2003-194000 | 7/2003 |
| JP | 2012-218099 | 11/2012 |

OTHER PUBLICATIONS

Office Action dated Oct. 23, 2019 in corresponding Japanese Patent Application No. 2017-114261 (with English Translation), 10 pages.

* cited by examiner

SILENCER AND EJECTOR IN WHICH SILENCER IS USED

CROSS-REFERENCE TO RELATED APPLICATION

This application is based upon and claims the benefit of priority from Japanese Patent Application No. 2017-114261 filed on Jun. 9, 2017, the contents of which are incorporated herein by reference.

BACKGROUND OF THE INVENTION

Field of the Invention

The present invention relates to a silencer adapted to reduce discharge noise of a pressure fluid that is discharged from a fluid pressure device, as well as to an ejector in which such a silencer is used.

Description of the Related Art

Conventionally, discharge noise of a pressure fluid (compressed air) that is discharged from a fluid pressure device such as an ejector is large, and therefore, by installing a silencer on the side of a discharge port of the fluid pressure device, lessening of the discharge noise can be achieved (See Japanese Laid-Open Patent Publication No. 2012-218099). This type of silencer is equipped with a hollow tubular portion in which a discharge flow passage is formed that communicates with the discharge port of the fluid pressure device, a sound absorbing member provided in the discharge flow passage, and a discharge port disposed at a terminal end position of the discharge flow passage.

SUMMARY OF THE INVENTION

In the above-described conventional technique, a configuration is provided in which the discharge port is formed along an axial direction of the silencer, and the pressure fluid having passed through the discharge flow passage is discharged along the axial direction. Therefore, when the silencer is installed in the fluid pressure device, it is necessary to install the fluid pressure device by separating the discharge port of the silencer away from an obstacle such as a wall surface or the like, so as not to hinder the discharge from the discharge port, and thus a restriction is placed on the installation location of the fluid pressure device. Further, since the discharge port is provided in only one location, for example, in the case that the silencer is attached to the ejector, there is a problem in that performance of the suction flow rate and the vacuum pressure deteriorates when the discharge port is closed.

Thus, an object of the present invention is to provide a silencer and an ejector in which such a silencer is used, wherein the installation location of the fluid pressure device to which the silencer is attached is not restricted, discharge from the discharge port is carried out without any impediment, and discharge noise is reduced.

The silencer of the present invention comprises a hollow tubular portion in which a discharge flow passage is formed that communicates, on one end side of the tubular portion, with a discharge port of a fluid pressure device through which a pressure fluid is discharged, a cap member attached to another end part of the tubular portion, a sound absorbing member attached to an inner wall surface of the tubular portion, and a plurality of discharge ports adapted to discharge the pressure fluid, which has passed through the discharge flow passage in an axial direction of the tubular portion, in radial directions perpendicular to the axial direction.

In accordance with the silencer of the present invention, the installation location of the fluid pressure device to which the silencer is attached is not restricted, discharge from the discharge port is carried out without any impediment, and discharge noise is reduced. More specifically, even in the case that the fluid pressure device to which the silencer is attached is installed in any arbitrary orientation, discharge gas can be discharged from the plurality of discharge ports in directions perpendicular to the axial direction of the tubular portion, while in addition, the silencer can be installed without separating the fluid pressure device a certain distance away from a wall surface or the like. Further, since the plurality of discharge ports are provided in the silencer, unlike the case in which a discharge port is provided at only one location, there is an advantage in that it is difficult for the ports to be closed from the exterior. Furthermore, since the plurality of discharge ports are dispersed and act to discharge the pressure fluid, the discharge pressure can be reduced, and the silencing effect is remarkable.

Further, in the silencer of the present invention, the plurality of discharge ports may be provided in the cap member, and may be oriented toward and open in the radial directions. In accordance with this feature, the discharge gas discharged from the discharge port can be discharged in directions perpendicular to the axial direction, which is helpful for reducing discharge noise.

Further, in the silencer of the present invention, the tubular portion may include a tubular partition wall that extends in the axial direction up to a vicinity of the cap member and partitions the discharge flow passage, and the discharge flow passage may be constituted from a first discharge flow passage, a starting end of which faces toward the discharge port, and which extends to the vicinity of the cap member along a wall surface on an inner side of the partition wall, a second discharge flow passage adapted to change a flow direction from a terminal end part of the first discharge flow passage toward an outer side in the radial direction, and which is folded back on an opposite side of the cap member in the axial direction along the inner wall surface of the cap member, and a third discharge flow passage that extends from a terminal end part of the second discharge flow passage to the one end side of the tubular portion along a wall surface on an outer side of the partition wall, wherein the plurality of discharge ports may be formed in a terminal end part of the third discharge flow passage. Consequently, since the discharge flow passage is folded back on the opposite side of the cap member, and the interval over which the sound absorbing member and the pressure fluid come into contact with each other is lengthened, the sound absorbing power can be enhanced.

Further, in the silencer of the present invention, the sound absorbing member may be constituted from a first sound absorbing member disposed along the first discharge flow passage, a second sound absorbing member disposed along the second discharge flow passage and the third discharge flow passage, and a third sound absorbing member disposed in the terminal end part of the third discharge flow passage, wherein the second sound absorbing member may include a curved portion at a location corresponding to the terminal end part of the second discharge flow passage. Consequently, the silencer can be assembled by first sequentially installing the third sound absorbing member, the first sound absorbing member, and the second sound absorbing member in this order along the partition wall in the interior of the tubular portion, and thereafter, attaching the cap member. Also, disassembly of the silencer is easy to perform, and it is easy to replace the silencer in component units thereof.

In the silencer of the present invention, a sound absorbing ring having an opening with a diameter greater than an inner diameter of the sound absorbing member may be provided between the sound absorbing member and the cap member. In accordance with this feature, it is possible to further reduce discharge sounds at a position in the vicinity of the discharge ports that are formed in the cap member, without disturbing the flow of the discharge gas.

Further, in the silencer of the present invention, the tubular portion may include a clip attachment part formed in a groove shape on an outer circumferential surface of the tubular portion, and the clip attachment part may engage a clip member that is inserted into a hole formed in the fluid pressure device. In accordance with this feature, by attaching the clip member to the clip attachment part, the silencer and the fluid pressure device can be integrated, and hence it is possible to prevent the silencer from coming out from the fluid pressure device. Furthermore, using the clip member, the silencer can be easily attached to and detached from the fluid pressure device.

Further, in the silencer of the present invention, the tubular portion may include a male screw member which is screwed in and fixed with respect to a female screw member formed in the fluid pressure device. In accordance with this feature, the silencer can be easily attached and detached with respect to the fluid pressure device.

Further still, an ejector of the present invention comprises an ejector body formed with an internal space communicating with an air supply port and a suction port, a nozzle disposed in the internal space, and adapted to inject a pressure fluid supplied from the air supply port, and generate a negative pressure for sucking fluid from the suction port, a diffuser provided in the internal space on a more downstream side than the nozzle, and having a discharge port adapted to discharge the pressure fluid together with the fluid, and a silencer facing toward the discharge port, and which is attached to the ejector body, wherein the silencer includes a hollow tubular portion in which a discharge flow passage is formed that communicates, on one end side of the tubular portion, with the discharge port, a cap member attached to another end part of the tubular portion, a sound absorbing member attached to an inner wall surface of the tubular portion, and a plurality of discharge ports adapted to discharge the pressure fluid, which has passed through the discharge flow passage in an axial direction of the tubular portion, in radial directions perpendicular to the axial direction.

In accordance with the ejector of the present invention, the installation location of the ejector to which the silencer is attached is not restricted, discharge from the discharge port is carried out without any impediment, and discharge noise is reduced. More specifically, even in the case that the ejector to which the silencer is attached is installed in any arbitrary orientation, discharge gas can be discharged from the plurality of discharge ports in directions perpendicular to the axial direction of the tubular portion, while in addition, the silencer can be installed without separating the ejector a certain distance away from a wall surface or the like. Further, since the plurality of discharge ports are provided in the silencer, unlike the case in which a discharge port is provided at only one location, there is an advantage in that it is difficult for the ports to be closed from the exterior. Furthermore, since the plurality of discharge ports are dispersed and act to discharge the pressure fluid, the discharge pressure can be reduced, and the silencing effect is remarkable.

According to the present invention, it is possible to provide a silencer and an ejector using a silencer, in which the installation location of the fluid pressure device to which the silencer is attached is not restricted, discharge from the discharge port is carried out without any impediment, and discharge noise is reduced.

The above and other objects, features, and advantages of the present invention will become more apparent from the following description when taken in conjunction with the accompanying drawings, in which preferred embodiments of the present invention are shown by way of illustrative example.

DESCRIPTION OF THE PREFERRED EMBODIMENTS

Preferred embodiments of a silencer according to the present invention in relation to an ejector in which the silencer is incorporated will be described in detail below with reference to the accompanying drawings.

Figure 1:
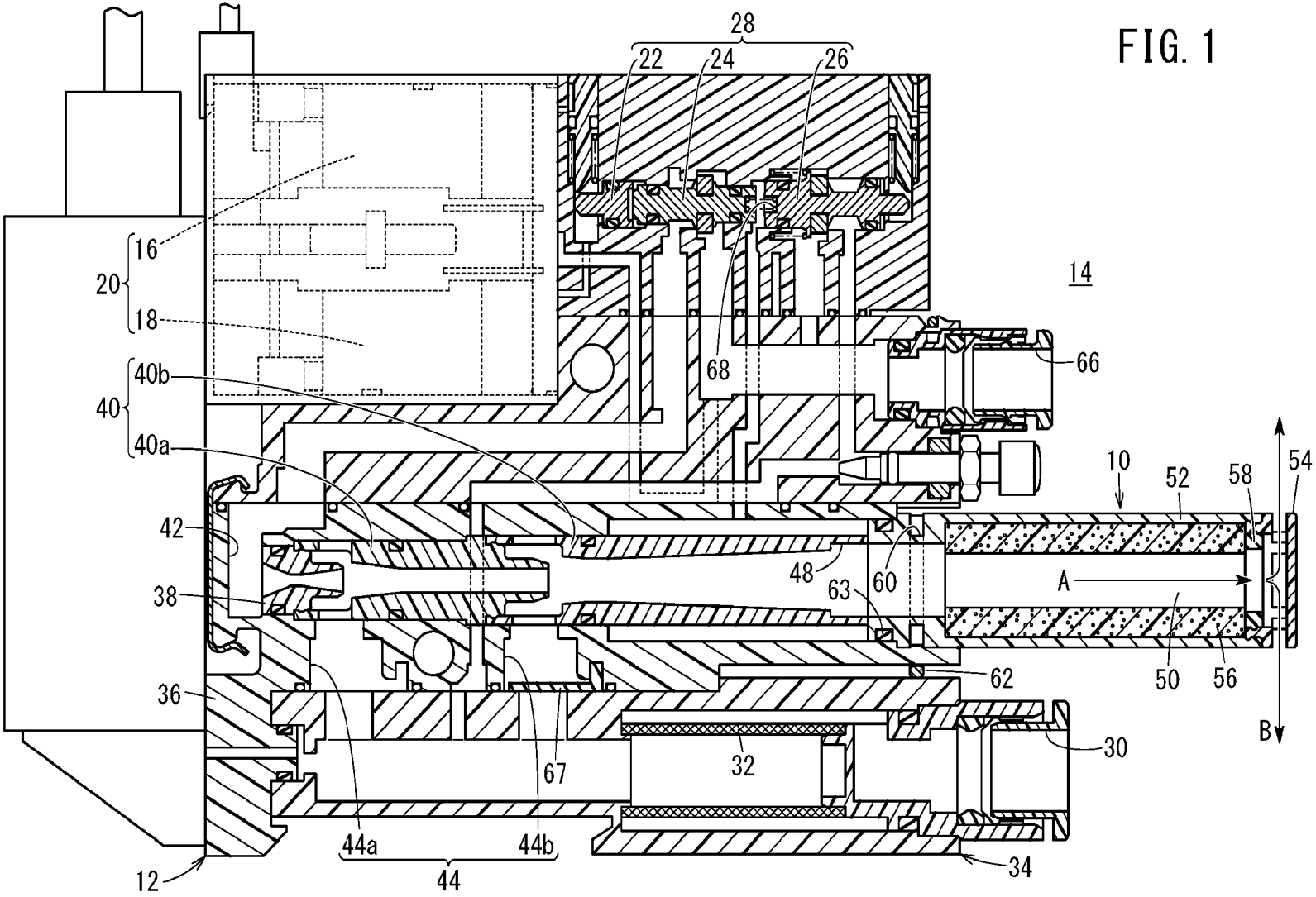
FIG. 1 is a cross-sectional view showing a vacuum generating unit including an ejector to which a silencer according to a first embodiment is attached.
Figure 2:
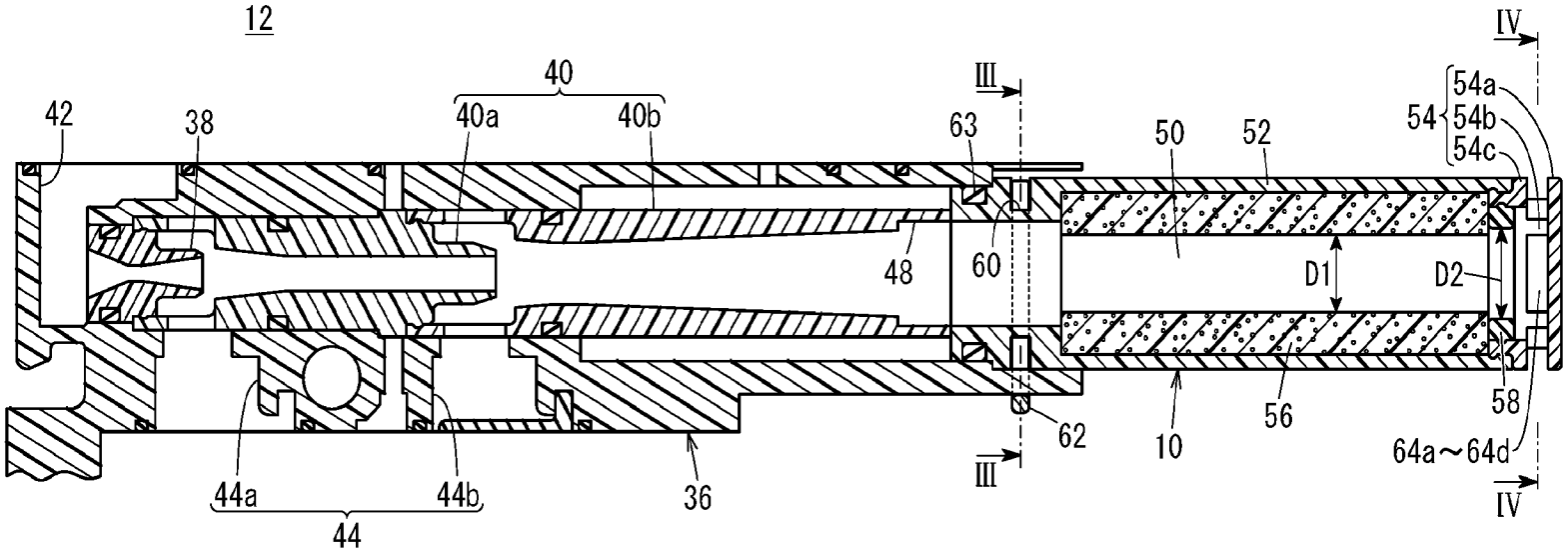
FIG. 2 is a cross-sectional view showing the ejector illustrated in FIG. 1.
Figure 3:
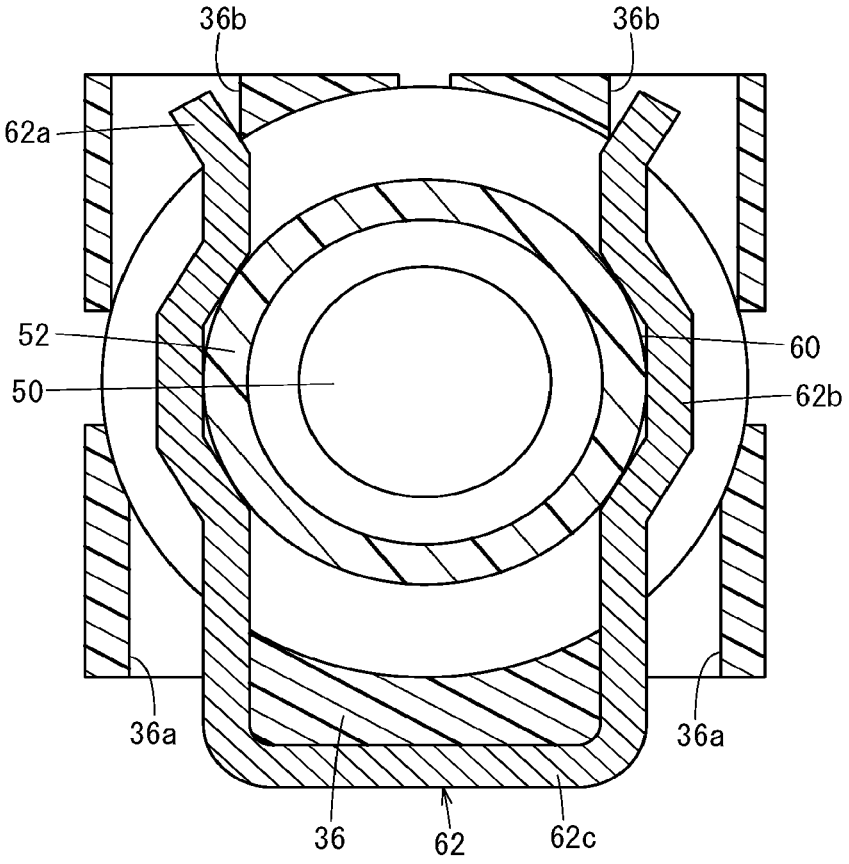
FIG. 3 is a cross-sectional view taken along line of the silencer and the ejector shown in FIG. 2.
Figure 4:
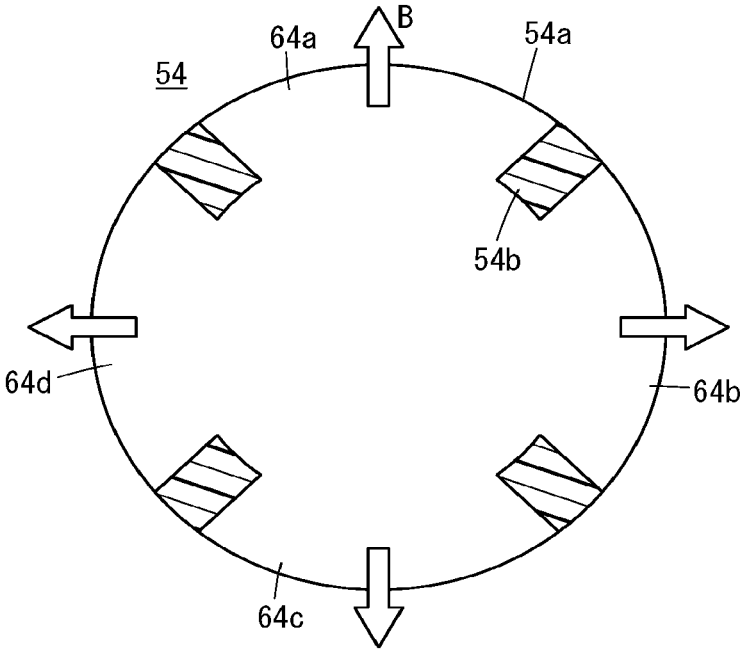
FIG. 4 is a cross-sectional view taken along line IV-IV of the silencer shown in FIG. 2.

FIG. 1 is a cross-sectional view showing a vacuum generating unit 14 including an ejector 12 to which a silencer 10 according to a first embodiment is attached, FIG. 2 is a cross-sectional view showing the ejector 12 illustrated in FIG. 1, FIG. 3 is a cross-sectional view taken along line of the silencer 10 and the ejector 12 shown in FIG. 2, and FIG. 4 is a cross-sectional view taken along line IV-IV of the silencer 10 shown in FIG. 2.

As shown in FIG. 1, the vacuum generating unit 14 is constituted from the ejector 12 which functions as a vacuum generating mechanism, a solenoid valve unit 20 having a vacuum breaking pilot valve 16 and a vacuum supplying pilot valve 18, a switching valve unit 28, and a filter unit 34 adapted to remove dust and the like contained within the fluid flowing from the vacuum port 30 by a filter 32 provided therein. The switching valve unit 28 includes a piston 22, a vacuum supply valve 24, and a vacuum breaking valve 26, and is switched between a vacuum generating state in which a negative pressure is generated by the piston 22 being displaced under a supply action of pilot air, and a state in which the negative pressure is released to atmospheric pressure. Between the vacuum supply valve 24 and the vacuum breaking valve 26, a spring 68 is provided for urging the vacuum supply valve 24 in a valve closing direction.

As shown in FIGS. 1 and 2, the ejector 12 includes an ejector body 36, a nozzle 38, a diffuser 40, and the silencer 10. An air supply port 42 and a suction port 44 are provided, and an internal space that communicates with these ports is formed in the ejector body 36.

The nozzle 38 is disposed between the air supply port 42 and the suction port 44 in the internal space of the ejector body 36, and ejects a pressure fluid (compressed air), which is supplied from the air supply port 42, toward the diffuser 40, to thereby generate a negative pressure for aspirating a fluid (air) leading to the vacuum port 30 from the suction port 44.

The diffuser 40 is made up from a first diffuser 40*a* and a second diffuser 40*b* arranged in tandem, and is provided on a downstream side of the nozzle 38 in the internal space of the ejector body 36. The second diffuser 40*b* includes a discharge port 48.

The ejector body 36 includes a first suction port 44*a* and a second suction port 44*b* which constitute the suction port 44 on the side of the filter unit 34. The first suction port 44*a* communicates with an internal space formed between the first diffuser 40*a* and the nozzle 38. The second suction port 44*b* communicates with an internal space formed between the first diffuser 40*a* and the second diffuser 40*b*. Between the second suction port 44*b* and the filter unit 34, a check valve 67 is provided, which is made of a flexible member that allows fluid to flow to the second suction port 44*b* from the side of the filter unit 34.

As shown in FIGS. 2 and 3, one end portion of the silencer 10 (the left end portion in FIG. 2) faces toward the discharge port 48, and the other end portion thereof (the right end portion in FIG. 2) projects outwardly from the ejector body 36. The silencer 10 includes a tubular portion 52, a cap member 54, and a sound absorbing member 56. The tubular portion 52 includes a discharge flow passage 50 that communicates with the discharge port 48 on one end side thereof. The tubular portion 52 is hollow. The cap member 54 is disposed on the other end (the right end portion in FIG. 2) of the tubular portion 52. The sound absorbing member 56 is attached to an inner wall surface of the tubular portion 52. The sound absorbing member 56 is of a cylindrical shape, and an internal space thereof which extends in the axial direction is closed by the cap member 54. The sound absorbing member 56 is composed of a sound absorbing material which is formed in a sponge-like shape using, for example, a resin such as polyvinyl alcohol as the material thereof. Further, between the cap member 54 and the sound absorbing member 56, a sound absorbing ring 58 is provided having an opening with a diameter D2 that is greater than an inner diameter D1 of the sound absorbing member 56.

A clip attachment part 60 made up from an annular groove is formed on an outer circumferential surface of one end side of the tubular portion 52 of the silencer 10. As shown in FIG. 3, the groove shaped clip attachment part 60 engages with a substantially U-shaped clip member 62, which is inserted from a side on a distal end part 62*a* thereof into holes 36*a*, 36*b* formed in the ejector body 36. Bent portions 62*b* which are formed in the center of the clip member 62 are placed in abutment so as to sandwich a groove bottom portion of the clip attachment part 60 from left and right sides thereof. The gripping part 62*c* of the clip member 62 is placed in abutment against a lower surface of the ejector body 36. By attaching the clip member 62 to the clip attachment part 60, the silencer 10 and the ejector 12 can be integrated, and hence it is possible to prevent the silencer 10 from coming out from the ejector body 36. Further, an annular seal member 63 is disposed at a connecting portion between an outer circumferential surface of the tubular portion 52 and the ejector body 36, to thereby prevent outflowing of the pressure fluid between the ejector 12 and the silencer 10.

Further, as shown in FIGS. 2 and 4, the cap member 54 is made up from a disk-shaped distal end part 54*a*, prism-shaped parts 54*b* that support the distal end part 54*a*, and an annular connecting part 54*c* that supports the prism-shaped parts 54*b* and is fitted into the tubular portion 52. The prism-shaped parts 54*b* form a bridge between the distal end part 54*a* and the connecting part 54*c*, and are formed by four columnar bodies which are spaced equidistantly from each other, and as a result, four discharge ports 64*a* to 64*d* are formed thereby. The discharge ports 64*a* to 64*d* discharge the fluid, which has passed in an axial direction (straight direction) through the discharge flow passage 50, in radial directions perpendicular to the axial direction. The number of discharge ports may be of any plural number, and is not limited to four.

Next, operations and effects of the silencer 10 and the vacuum generating unit 14, which are configured in the manner described above, will be described.

When the vacuum supplying pilot valve 18 is not energized, both the vacuum supplying pilot valve 18 and the vacuum supply valve 24 are placed in a closed state. Next, when the vacuum supplying pilot valve 18 is energized by a non-illustrated power supply source, the vacuum supplying pilot valve 18 is opened, and a pilot pressure is supplied to the piston 22.

Consequently, the piston 22 moves toward the vacuum supply valve 24 (in a rightward direction in FIG. 1) and pushes the vacuum supply valve 24, thereby opening the vacuum supply valve 24. The pressure fluid (compressed air), which is supplied to an internal flow passage of the switching valve unit 28 from a supply port 66 connected to a non-illustrated pressure fluid supply source, passes through the vacuum supply valve 24 and is supplied to one end side of the nozzle 38 of the ejector 12 via the air supply port 42.

The pressure fluid supplied from the one end side of the nozzle 38 is throttled at a center portion where the inner diameter is narrowest in the nozzle 38, and thereafter, is vigorously ejected from the other end side where the inner diameter is expanded along the axial direction from the center portion.

Consequently, the speed of the pressure fluid becomes higher at the other end side of the nozzle 38 than at the one end side, and the pressure at the other end side becomes lower than the pressure at the one end side. In this case, since the ejector 12 communicates with the internal space of the filter unit 34 through the first suction port 44*a* that is formed in the ejector body 36, outside air is sucked in from the vacuum port 30 due to the negative pressure generated at the first suction port 44*a* of the ejector body 36. Therefore, the vacuum port 30 is placed in a negative pressure state. Moreover, the outside air passes through the filter 32 in the internal space of the filter unit 34 to remove fine dust and the like contained therein, and thereafter, the air is introduced into the ejector 12 from the first suction port 44*a*.

The first diffuser 40*a* ejects the pressure fluid, which is ejected from the other end of the nozzle 38, toward the second diffuser 40*b* together with the fluid that is sucked in from the first suction port 44*a*.

As a result, a negative pressure is also generated at the second suction port 44*b*, and in the second diffuser 40*b*, the pressure fluid ejected from the first diffuser 40*a*, together with the fluid that is sucked in from the second suction port 44*b* are ejected from the discharge port 48 toward the discharge flow passage 50 of the silencer 10.

When a non-illustrated workpiece is attracted, for example, to a non-illustrated suction tool that is connected to the vacuum port 30, the degree of vacuum inside the filter unit 34 and the suction tool increases. In addition, when the degree of vacuum in the internal space of the filter unit 34 becomes higher than the degree of vacuum of the second suction port 44*b*, the check valve 67, which is provided in the second suction port 44*b*, closes due to such a negative pressure difference, and therefore, the fluid ejected from the discharge port 48 becomes only the fluid that is ejected therein from the first diffuser 40*a*.

In the silencer 10, when the fluid ejected from the ejector 12 is supplied to the discharge flow passage 50, which is disposed along the axial direction of the tubular portion 52, the fluid moves straight forward (in the direction of the arrow A in FIG. 1) along the axial direction toward the cap member 54, while discharge sounds are absorbed by the sound absorbing member 56 provided on the inner wall surface of the tubular portion 52. The fluid that has reached the cap member 54 is discharged in directions perpendicular to the axial direction of the tubular portion 52 (in the directions of the arrows B shown in FIGS. 1 and 4) from the plurality of discharge ports 64*a* to 64*d* provided in the cap member 54 and which are oriented toward and open in the radial directions.

In addition, when supply of energy to the vacuum supplying pilot valve 18 is stopped, the restorative force of the spring 68 disposed between the vacuum supply valve 24 and the vacuum breaking valve 26 causes the vacuum supply valve 24 to return to the closed state, and since supply of the pressure fluid to the ejector 12 is stopped, generation of the vacuum is also stopped.

In the foregoing manner, in the silencer 10 according to the present embodiment, the discharge gas can be discharged from the plurality of discharge ports 64*a* to 64*d* in directions perpendicular to the axial direction of the tubular portion 52. Therefore, it is possible for the fluid pressure device to be installed without being separated a certain distance away from a wall surface or the like, and the installation location thereof is not restricted.

Further, since the plurality of discharge ports 64*a* to 64*d* are provided, unlike the case in which a discharge port is provided at only one location as in the conventional art, there is an advantage in that it is difficult for the ports to be closed. More specifically, when the vacuum generating unit 14 is attached to the ejector 12, even in the case that one location is closed, for example, it is possible to prevent a significant decrease in product performance such as the suction flow rate or the vacuum pressure.

Furthermore, since the plurality of discharge ports 64*a* to 64*d* are dispersed and act to discharge the pressure fluid, an advantage is achieved in that the discharge pressure can be reduced, and discharge noises can be reduced more so than in the case of a discharge port being provided at only one location.

Further still, in the silencer 10 according to the present embodiment, the plurality of discharge ports 64*a* to 64*d* are oriented toward and open in the radial directions in the cap member 54. In accordance with this feature, the discharge gas discharged from the discharge port 48 can be discharged in directions perpendicular to the axial direction, which is helpful for reducing discharge noise.

Further, in the silencer 10 of the present embodiment, the sound absorbing ring 58, having an opening with a diameter D2 that is greater than the inner diameter D1 of the sound absorbing member 56, is provided between the sound absorbing member 56 and the cap member 54. In accordance with this feature, it is possible to further reduce discharge sounds at a position in the vicinity of the discharge ports 64*a* to 64*d* that are formed in the cap member 54, without disturbing the flow of the discharge gas.

Further still, in the silencer 10 of the present embodiment, the tubular portion 52 includes the clip attachment part 60 formed in a groove shape on the outer circumferential surface thereof, and the clip attachment part 60 engages the clip member 62 that is inserted into the holes 36*a*, 36*b* formed in the ejector 12 (fluid pressure device). By attaching the clip member 62 to the clip attachment part 60, the silencer 10 and the ejector 12 can be integrated, and hence it is possible to prevent the silencer 10 from coming out from the ejector body 36. Furthermore, using the clip member 62, the silencer 10 can be easily attached to and detached from the ejector 12.

Next, a silencer 100 according to a second embodiment will be described. Constituent elements thereof which are the same as those of the silencer 10 according to the above-described first embodiment are denoted with the same reference numerals, and detailed description of such features is omitted.

Figure 5:
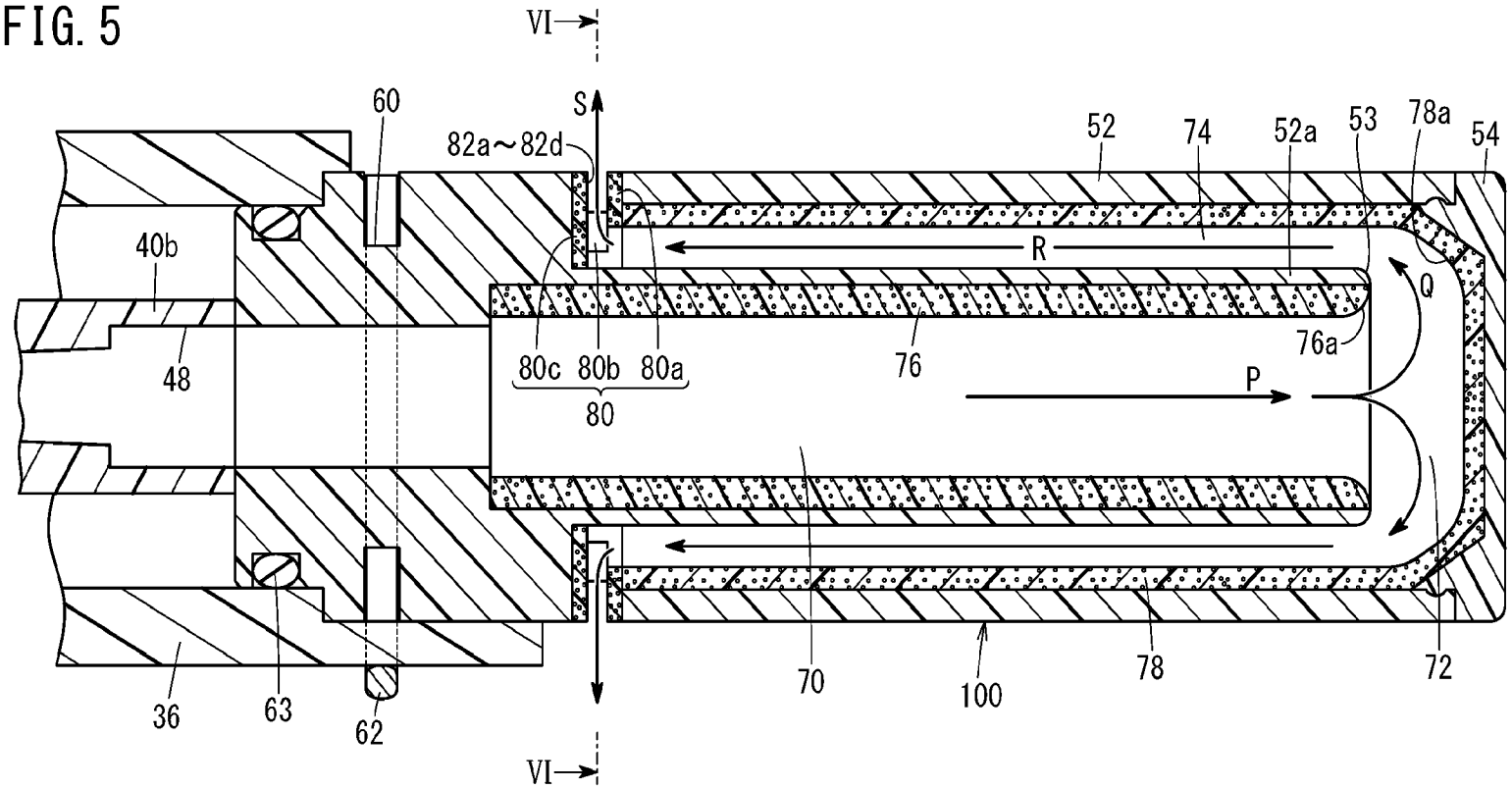
FIG. 5 is a cross-sectional view showing a silencer according to a second embodiment.
Figure 6:
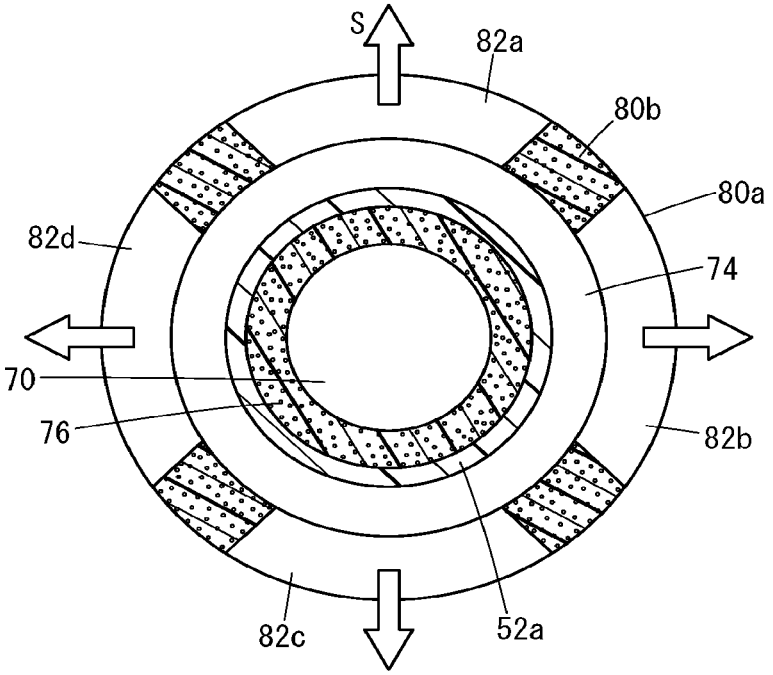
FIG. 6 is a cross-sectional view taken along line VI-VI of the silencer shown in FIG. 5.
Figure 7:
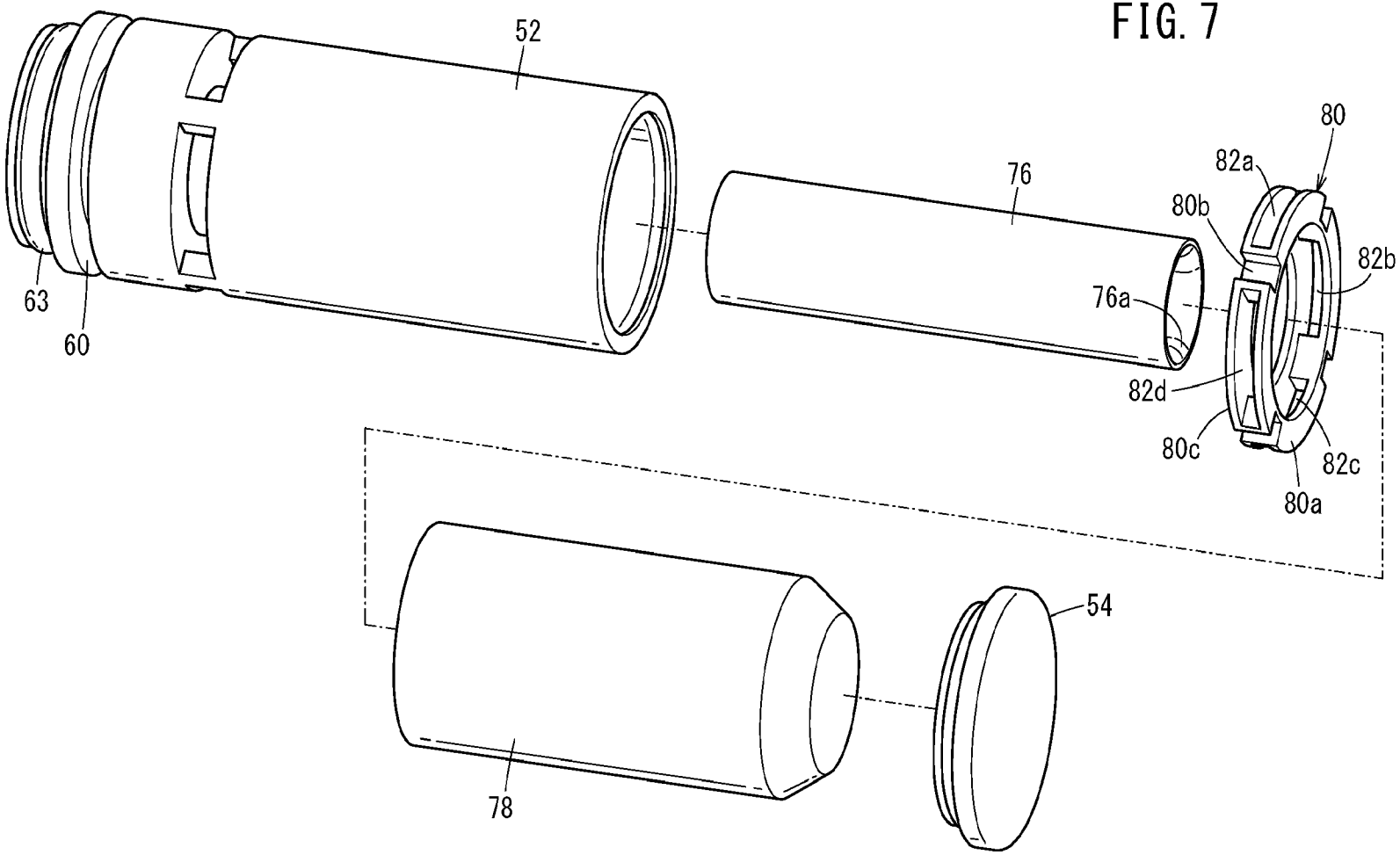
FIG. 7 is an exploded perspective view of the silencer shown in FIG. 5.

FIG. 5 is a cross-sectional view showing the silencer 100 according to the second embodiment, FIG. 6 is a cross-sectional view taken along line VI-VI of the silencer 100 shown in FIG. 5, and FIG. 7 is an exploded perspective view of the silencer 100 shown in FIG. 5. As shown in FIGS. 5 to 7, in the silencer 100 according to the present embodiment, the tubular portion 52 is in the form of a double structure, including a cylindrical shaped partition wall 52*a* defining a discharge flow passage along the axial direction. Therefore, the shape of the discharge flow passage provided inside the tubular portion 52 differs from that of the first embodiment. The discharge flow passage in the present embodiment is constituted from a first discharge flow passage 70, a second discharge flow passage 72, and a third discharge flow passage 74.

As shown in FIG. 5, a starting end of the first discharge flow passage 70 faces toward the discharge port 48, and the first discharge flow passage 70 extends in the axial direction of the tubular portion 52 (in the direction of the arrow P in FIG. 5) along the inner wall surface of the partition wall 52*a* to the vicinity of the cap member 54. The second discharge flow passage 72 changes the flow direction from the terminal end part of the first discharge flow passage 70 toward an outer side in the radial direction of the tubular portion 52, and is folded back on an opposite side of the cap member 54 (in the direction of the arrow Q in FIG. 5) in the axial direction along the inner wall surface of the cap member 54. The third discharge flow passage 74 extends from a terminal end part of the second discharge flow passage 72 to the one end side of the tubular portion 52 in parallel with the axial direction (in the direction of the arrow R in FIG. 5) along a wall surface on an outer side of the partition wall 52*a*.

Further, a first sound absorbing member 76 is disposed along the first discharge flow passage 70 on a wall surface on an inner side in the radial direction of the partition wall 52*a* of the tubular portion 52. Further, a second sound absorbing member 78 is disposed along the second discharge flow passage 72 and the third discharge flow passage 74 on an inner wall surface on an outer side in the radial direction of the tubular portion 52 and on an inner wall surface of the cap member 54. The second sound absorbing member 78 has a curved portion 78*a* at a position corresponding to a terminal end part of the second discharge flow passage 72. Further, in the first discharge flow passage 70, a corner portion of the terminal end part 76*a* of the first sound absorbing member 76, and in the third discharge flow passage 74, a corner portion of the terminal end part 53 of the partition wall 52*a* are formed in rounded shapes, respectively. In addition, a third sound absorbing member 80 is disposed at a terminal end part of the third discharge flow passage 74. The first sound absorbing member 76, the second sound absorbing member 78, and the third sound absorbing member 80 are formed in sponge-like shapes using, for example, a resin such as polyvinyl alcohol as the material thereof.

Further, as shown in FIG. 7, the third sound absorbing member 80 is made up from a first annular section 80*a*, four connecting parts 80*b*, and a second annular section 80*c*. As shown in FIG. 5, the inner diameter of the first annular section 80*a* is set in matching relation with the outer diameter of the cross-sectional shape of the third discharge flow passage 74, so as not to hinder discharging therefrom. The inner diameter of the second annular section 80*c* is set in matching relation with the outer diameter of the cross-sectional shape of the partition wall 52*a* of the tubular portion 52. On the outer circumference of the third sound absorbing member 80, a plurality of discharge ports 82*a* to 82*d* are formed, which open in directions (the directions of the arrows S shown in FIGS. 5 and 6) perpendicular to the direction of the third discharge flow passage 74.

As shown in FIG. 7, the silencer 100 according to the present invention is assembled by first sequentially installing the annular shaped third sound absorbing member 80, the cylindrical shaped first sound absorbing member 76, and the cup shaped second sound absorbing member 78 in this order along the partition wall 52*a* in the interior of the tubular portion 52, and thereafter, attaching the cap member 54. Disassembly of the silencer 100 is also easy to perform, and it is easy to replace the silencer 100 in component units thereof.

Next, operations and effects of the silencer 100 according to the present embodiment, which is configured in the manner described above, will be described. Moreover, operations and effects in portions other than the silencer 100 are the same as those in the above-described first embodiment, and detailed description thereof will be omitted.

In the silencer 100, when the fluid ejected from the ejector 12 is supplied to the first discharge flow passage 70, which is disposed along the axial direction of the tubular portion 52, the fluid moves straight forward (in the direction of the arrow P in FIG. 5) along the axial direction toward the cap member 54, while discharge sounds are absorbed by the first sound absorbing member 76 provided on the inner wall surface of the partition wall 52*a* of the tubular portion 52.

The fluid that has reached the cap member 54 passes through the curved second discharge flow passage 72, which is folded back on an opposite side of the cap member 54 (in the direction of the arrow Q in FIG. 5), and thereafter, flows into the third discharge flow passage 74. The fluid that has flowed into the third discharge flow passage 74 moves straight forward in a direction (the direction of the arrow R in FIG. 5) opposite to the direction of the first discharge flow passage 70, and the fluid is discharged in directions perpendicular to the axial direction of the tubular portion 52 (in the directions of the arrows S shown in FIGS. 5 and 6) from the discharge ports 82*a* to 82*d*, which are provided in the third sound absorbing member 80 positioned at the terminal end part of the third discharge flow passage 74.

In the silencer 100 according to the present embodiment, in comparison with the above-described first embodiment, the discharge flow passage (second discharge flow passage 72) is folded back on the opposite side of the cap member 54, and the interval over which the fluid (discharge gas) is in contact with the sound absorbing members (the first sound absorbing member 76, the second sound absorbing member 78, and the third sound absorbing member 80) becomes longer. Therefore, the sound absorbing power can be further enhanced. Further, the corner portions of the terminal end part 76*a* of the first sound absorbing member 76 and the terminal end part 53 of the partition wall 52*a* are formed respectively in rounded shapes, and the curved portion 78*a* of the second sound absorbing member 78 is formed in a curved shape. More specifically, between the terminal end part of the first discharge flow passage 70 and the starting end part of the third discharge flow passage 74, the discharge gas is capable of passing smoothly over the corner portions formed on the terminal end part 76*a* of the first sound absorbing member 76 and the terminal end part 53 of the partition wall 52*a*, and the curved portion 78*a* of the second sound absorbing member 78, and undergoes a change in direction (in the direction of the arrow Q in FIG. 5) toward the side of the third discharge flow passage 74. Therefore, the fluid can be smoothly discharged over the interval from the first discharge flow passage 70 to the third discharge flow passage 74.

Figure 8:
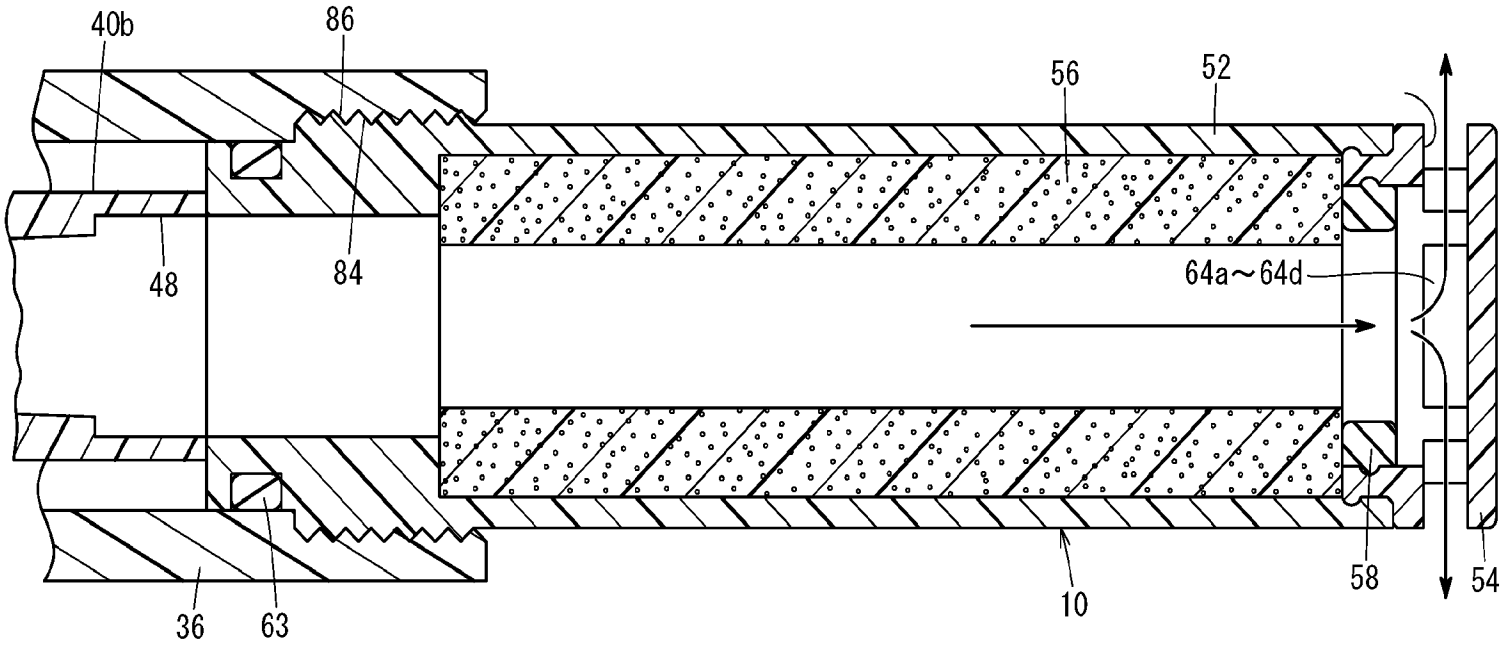
FIG. 8 is a cross-sectional view showing a modification of the silencer according to the first embodiment.

It is a matter of course that the silencer according to the present invention is not limited to the above-described embodiments, and various additional or modified configurations could be adopted therein without departing from the essence and gist of the present invention. For example, in the above-described first embodiment, the silencer 10 is fixed to the ejector 12 via the clip member 62. However, as shown in FIG. 8, a female screw member 84 may be provided on the side of the ejector body 36, and a male screw member 86, which is screwed in and fixed to the female screw member 84, may be provided on the side of the silencer 10. In accordance with this feature, the silencer 10 can be easily attached and detached without requiring a connecting member such as the clip member 62. Further, in the two embodiments described above, cases have been described respectively in which the silencers 10, 100 are attached with respect to the ejector 12. However, the same effects can be obtained even if the silencers 10, 100 are attached to another fluid pressure device.

What is claimed is:

1. A silencer comprising:

a hollow tubular portion in which a discharge flow passage is formed that communicates, on one end side of the tubular portion, with a discharge port of a fluid pressure device through which a pressure fluid is discharged;

a cap member attached to another end part of the tubular portion;

a sound absorbing member attached to an inner wall surface of the tubular portion; and a plurality of discharge ports adapted to discharge the pressure fluid, which has passed through the discharge flow passage in an axial direction of the tubular portion, in radial directions perpendicular to the axial direction, wherein:

the plurality of discharge ports are provided in the cap member and are oriented toward and open in the radial directions, and the plurality of discharge ports are partitioned by a plurality of columnar bodies which are spaced equidistantly from each other in a circumferential direction of the cap member, and the discharge ports are directly connected to the discharge flow passage without being separated by the sound absorbing member.

2. The silencer according to claim 1, wherein:

the tubular portion includes a tubular partition wall that extends in the axial direction up to a vicinity of the cap member and partitions the discharge flow passage; and the discharge flow passage is constituted from:

a first discharge flow passage, a starting end of which faces toward the discharge port, and which extends to the vicinity of the cap member along a wall surface on an inner side of the partition wall;

a second discharge flow passage adapted to change a flow direction from a terminal end part of the first discharge flow passage toward an outer side in the radial direction, and which is folded back on an opposite side of the cap member in the axial direction along the inner wall surface of the cap member; and a third discharge flow passage that extends from a terminal end part of the second discharge flow passage to the one end side of the tubular portion along a wall surface on an outer side of the partition wall;

wherein the plurality of discharge ports are formed in a terminal end part of the third discharge flow passage.

3. The silencer according to claim 1, wherein a sound absorbing ring having an opening with a diameter greater than an inner diameter of the sound absorbing member is provided between the sound absorbing member and the cap member.

4. The silencer according to claim 1, wherein:

the tubular portion includes a clip attachment part formed in a groove shape on an outer circumferential surface thereof; and the clip attachment part engages a clip member that is inserted into a hole formed in the fluid pressure device.

5. The silencer according to claim 1, wherein the tubular portion includes a male screw member which is screwed in and fixed with respect to a female screw member formed in the fluid pressure device.

6. A silencer comprising:

a hollow tubular portion in which a discharge flow passage is formed that communicates, on one end side of the tubular portion, with a discharge port of a fluid pressure device through which a pressure fluid is discharged;

a cap member attached to another end part of the tubular portion;

a sound absorbing member attached to an inner wall surface of the tubular portion: and a plurality of discharge ports adapted to discharge the pressure fluid, which has passed through the discharge flow passage in an axial direction of the tubular portion, in radial directions perpendicular to the axial direction, wherein the tubular portion includes a tubular partition wall that extends in the axial direction up to a vicinity of the cap member and partitions the discharge flow passage;

the discharge flow passage is constituted from:

a first discharge flow passage, a starting end of which faces toward the discharge port, and which extends to the vicinity of the cap member along a wall surface on an inner side of the partition wall;

a second discharge flow passage adapted to change a flow direction from a terminal end part of the first discharge flow passage toward an outer side in the radial direction, and which is folded back on an opposite side of the cap member in the axial direction along the inner wall surface of the cap member; and a third discharge flow passage that extends from a terminal end part of the second discharge flow passage to the one end side of the tubular portion along a wall surface on an outer side of the partition wall;

wherein the plurality of discharge ports are formed in a terminal end part of the third discharge flow passage.

wherein the sound absorbing member is constituted from:

a first sound absorbing member disposed along the first discharge flow passage;

a second sound absorbing member disposed along the second discharge flow passage and the third discharge flow passage; and a third sound absorbing member disposed in the terminal end part of the third discharge flow passage; and wherein the second sound absorbing member includes a curved portion at a location corresponding to the terminal end part of the second discharge flow passage.

7. An ejector comprising:

an ejector body formed with an internal space communicating with an air supply port and a suction port;

a nozzle disposed in the internal space, and adapted to inject a pressure fluid supplied from the air supply port, and generate a negative pressure for sucking fluid from the suction port;

a diffuser provided in the internal space on a more downstream side than the nozzle, and having a discharge port adapted to discharge the pressure fluid together with the fluid; and a silencer facing toward the discharge port, and which is attached to the ejector body;

wherein the silencer includes:

a hollow tubular portion in which a discharge flow passage is formed that communicates, on one end side of the tubular portion, with the discharge port;

a cap member attached to another end part of the tubular portion;

a sound absorbing member attached to an inner wall surface of the tubular portion; and a plurality of discharge ports adapted to discharge the pressure fluid, which has passed through the discharge flow passage in an axial direction of the tubular portion, in radial directions perpendicular to the axial direction, the plurality of discharge ports are provided in the cap member and are oriented toward and open in the radial directions, and the plurality of discharge ports are partitioned by a plurality of columnar bodies which are spaced equidistantly from each other in a circumferential direction of the cap member, and the discharge ports are directly connected to the discharge flow passage without being separated by the sound absorbing member.

* * * * *